US006784801B2

(12) United States Patent
Watanabe et al.

(10) Patent No.: US 6,784,801 B2
(45) Date of Patent: Aug. 31, 2004

(54) ELECTRIC APPLIANCE MONITORING SYSTEM

(75) Inventors: Hiroomi Watanabe, Musashino (JP); Shigeki Fujii, Iruma (JP)

(73) Assignee: TEAC Corporation, Tokyo (JP)

( * ) Notice: Subject to any disclaimer, the term of this patent is extended or adjusted under 35 U.S.C. 154(b) by 75 days.

(21) Appl. No.: 10/198,870

(22) Filed: Jul. 19, 2002

(65) Prior Publication Data

US 2003/0058101 A1 Mar. 27, 2003

(30) Foreign Application Priority Data

Sep. 27, 2001 (JP) ..... 2001-296942

(51) Int. Cl.[7] ..... G08B 21/00
(52) U.S. Cl. ..... 340/679; 340/539.14; 340/585
(58) Field of Search ..... 340/311.2, 539.14, 340/539.11, 657, 679, 683, 5.42, 7.32, 825.69, 533, 585; 379/106.01; 455/11.1, 88, 507; 62/127, 130, 175

(56) References Cited

U.S. PATENT DOCUMENTS 4,916,439 A * 4/1990 Estes et al. ..... 340/679
5,089,809 A * 2/1992 Carmichael, Jr. ..... 340/679
6,157,313 A * 12/2000 Emmermann ..... 340/5.42
6,374,079 B1 * 4/2002 Hsu ..... 455/11.1
6,424,252 B1 * 7/2002 Adler ..... 340/311.2

FOREIGN PATENT DOCUMENTS

JP 03151999 6/1991
JP 09327600 12/1997

* cited by examiner

*Primary Examiner*—Van T. Trieu
(74) *Attorney, Agent, or Firm*—Anderson Kill & Olick; Eugene Lieberstein; Michael J. Meller

(57) ABSTRACT

An electric appliance monitoring system that can report an operational state of an electric appliance includes a monitoring part and a transmission part. The monitoring part monitors the operational state of the electric appliance and outputs a detection signal to the transmission part. The transmission part transmits a signal corresponding to the detection signal output from the monitoring part.

13 Claims, 7 Drawing Sheets

ELECTRIC APPLIANCE MONITORING SYSTEM

BACKGROUND OF THE INVENTION

1. Field of the Invention

The present invention relates to an electric appliance monitoring system, and more particularly to an electric appliance monitoring system configured to report an operational state of an electric appliance to a distant place.

2. Description of the Related Art

Various electric appliances (for example, a washing machine, a drying machine, a refrigerator, a television, a stereo set, a video recorder, a personal computer, a DVD apparatus, a facsimile machine and the like) are provided in homes, workplaces, schools, public facilities and the like. Each of the electric appliances operates appropriately according to need.

Such electric appliances report their operational states by sounding a buzzer or displaying a message on a monitor. For example, a washing machine sounds a buzzer when a washing operation is done. Additionally, some stereo sets having a LCD monitor display a message on the LCD monitor so as to report that recording of a MD is finished, reproducing from a CD is finished and the like.

However, as mentioned above, when using the conventional electric appliance, a user needs to stay near to the electric appliance since it is necessary for the user to directly hear the buzzer or see the displayed message. Accordingly, when the user goes out or moves to another floor, the user cannot hear the buzzer or see the displayed message on the LCD monitor. Thus, the user cannot determine the operational state of the electric appliance.

Especially, it is difficult for the user to return to a laundromat with the right timing when the user intends to finish another errand (for example, shopping) while doing laundry since the user cannot determine the state of the laundering at the laundromat from another place. Thus, when the user is enjoying shopping leisurely after starting the washing and leaving the laundromat, there is a possibility that considerable time passes after the washing is finished and another person waiting,for his turn must bear a long waiting time. On the other hand, when the user returns to the laundromat before the washing is finished, the user has to wait until the washing is finished.

Additionally, when laundering the laundry at the laundromat, there is a possibility that the laundry is stolen if the laundry is left for a while after the laundering is finished. Thus, the user needs to watch the laundry until the laundering is finished.

SUMMARY OF THE INVENTION

It is a general object of the present invention to provide an improved and useful electric appliance monitoring system in which the above-mentioned problems are eliminated.

In order to achieve the above-mentioned object, according to one aspect of the present invention, there is provided an electric appliance monitoring system, including: a monitoring part that monitors an operational state of an electric appliance and outputs a detection signal; and a transmission part that transmits a signal corresponding to the detection signal output by the monitoring part.

According to the above-mentioned aspect of the present invention, it is possible to report the operational state of the electric appliance to a user even if the user is distant from the electric appliance.

Additionally, according to another aspect of the present invention, the above-mentioned electric appliance monitoring system further includes: a receiving part that receives the signal sent from the transmission part and outputs the received signal; and a reporting part that determines a monitoring result corresponding to the received signal output from the receiving part and reports the operational state of the electric appliance.

According to the above-mentioned aspect of the present invention, it is possible for the user to determine the operational state of the electric appliance by using the receiving part, even if the user is distant from the electric appliance. Thus, for example, the user can determine whether the user needs to return to the place where the electric appliance is installed.

Additionally, according to another aspect of the present invention, in the above-mentioned electric appliance monitoring system, the transmission part becomes communicative when a mobile phone number is input.

According to the above-mentioned aspect of the present invention, it is possible to report the operational state of the electric appliance to the user distant from the electric appliance by transmitting a signal to a mobile phone that the user has.

Additionally, according to another aspect of the present invention, in the above-mentioned electric appliance monitoring system, the reporting part reports the operational state of the electric appliance to a user of a mobile phone by using a speaker and/or a display screen of the mobile phone.

According to the above-mentioned aspect of the present invention, it is possible to easily report the operational state of the electric appliance to the user even if the user is running an errand in a distant place.

Additionally, according to another aspect of the present invention, in the above-mentioned electric appliance monitoring system, the monitoring part is provided between a power plug of the electric appliance and a receptacle, and monitors changes in the electric current at the power plug.

According to the above-mentioned aspect of the present invention, the monitoring part can be easily attached to an electric appliance that is already installed. Further, it is possible to monitor the operational state irrespective of the type of the electric appliance.

Other objects, features and advantages of the present invention will become more apparent from the following detailed description when read in conjunction with the following drawings.

DETAILED DESCRIPTION OF THE PREFERRED EMBODIMENTS

A description will be given of an embodiment of the present invention, with reference to the drawings.

Figure 1:
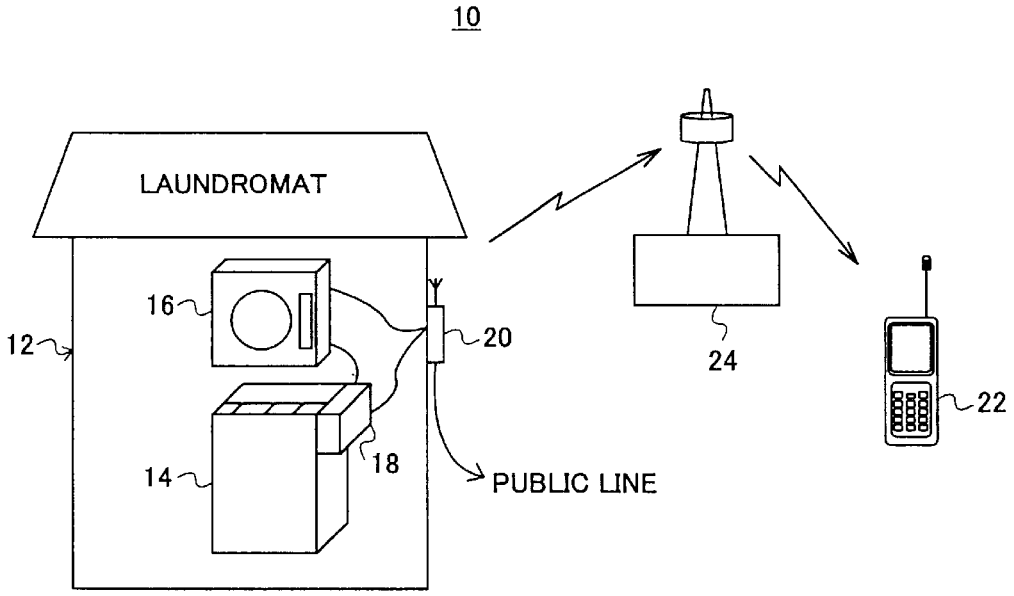
FIG. 1 is a schematic diagram showing one embodiment of an electric appliance monitoring system according to the present invention.

FIG. 1 is a schematic diagram showing an embodiment of an electric appliance monitoring system 10 according to the present invention.

As shown in FIG. 1, the electric appliance monitoring system 10 monitors the end of the operation of a washing machine 14 and a drying machine 16 installed in a laundromat 12. The electric appliance monitoring system 10 includes a monitoring apparatus 18 and a communication apparatus 20. The monitoring apparatus 18 monitors the operational state of electric appliances such as a washing machine 14 and a drying machine 16 provided in the laundromat 12. The communication apparatus 20 transmits a signal reporting the end of the operation (referred to as "operation end signal", hereinafter) according to a signal from the monitoring apparatus 18.

When a user has a mobile phone 22, the operation end signal is transmitted by radio wave from the communication apparatus 20 to the mobile phone 22 having a predetermined mobile phone number via the base station 24. Additionally, the communication apparatus 20 is also connected to a public line. The communication apparatus 20 transmits a signal indicating the operational state of the electric appliances such as the washing machine 14 and the drying machine 16 to a telephone (not shown) or a facsimile machine (not shown) via a telephone switchboard of a telephone carrier. Further, the communication apparatus 20 transmits the signal to a personal computer (not shown) of a user via the Internet.

Figure 2:
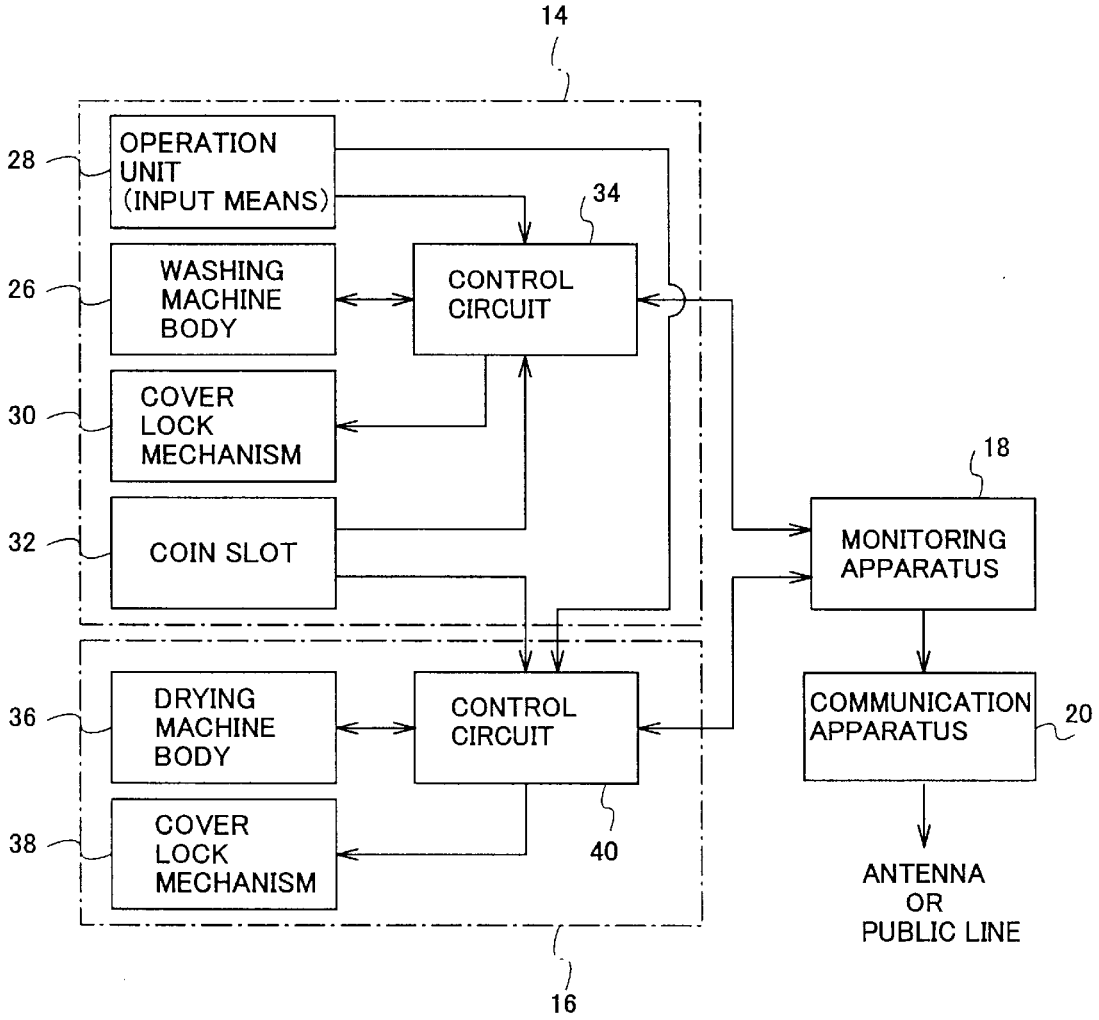
FIG. 2 is a block diagram showing the structure of the electric appliance monitoring system.

FIG. 2 is a block diagram showing the structure of the electric appliance monitoring system 10. As shown in FIG. 2, the washing machine 14 includes a washing machine body 26, an operation unit (input means) 28, an electromagnetic type cover lock mechanism 30, a coin slot 32, and a control circuit 34. The washing machine body 26 performs washing. The operation unit 28 is for inputting a mobile phone number of a mobile phone and a secret identification code for unlocking a cover lock of the washing machine body 26. The electromagnetic type cover lock mechanism 30 is for locking a cover of the washing machine body 26. The coin slot 32 is for paying the charge. The control circuit 34 registers data input from the operation unit 28, and at the same time, controls the operation of the washing machine body 26.

The drying machine 16 includes a drying machine body 36, an electromagnetic type cover lock mechanism 38, and a control circuit 40. The drying machine body 36 dries the laundry. The electromagnetic type cover lock mechanism 38 locks a cover of the drying machine body 36. The control circuit 40 controls the operation of the drying machine body 36.

When coins are dropped in the coin slot 32 and the mobile phone number of the mobile phone 22 and a secret identification code are input from the operation unit 28, the above-mentioned control circuit 34 or 40 starts the operation (in this embodiment, washing or drying) by maintaining the electromagnetic type cover mechanism 30 or 38, respectively, locked. When the operation ends, the control circuit 34 or 40 outputs an operation end signal to the monitoring apparatus 18. The monitoring apparatus 18 transmits the operation end signal to the mobile phone 22 that a user has, or to a telephone, a facsimile machine, a personal computer or the like provided near to the user via the communication apparatus 20.

Therefore, even if the user moves to a place distant from the laundromat 12 after starting the washing or drying by putting in the laundry in the washing machine 14 or the drying machine 16, respectively, the user can be informed of the end of the washing or drying by the mobile phone 22 or other communication means (a telephone, a facsimile machine, a personal computer, and the like). Accordingly, after starting the operation of the washing machine 14 or the drying machine 16, the user can finish his/her errand in a place distant from the laundromat 12. At the same time, the user can also return to the laundromat 12 with the right timing after the operation of the washing machine 14 or the drying machine 16 ends. Thus, the user will not be kept waiting for the end of the operation by returning to the laudromat 12 early. Additionally, the user will not cause someone else inconvenience by returning to the laundromat 12 late.

Further, the washing machine 14 and the drying machine 16 have the electromagnetic type cover lock mechanisms 30 and 38, respectively, which unlock the respective cover locks only when a correct secret identification code is input. Therefore, it is possible to prevent a person other than the user from opening the cover arbitrarily. Accordingly, it is possible to prevent theft of the laundry.

Next, a description will be given of the control process performed by the control circuits 34 and 40, with reference to a flow chart shown in FIGS. 3 and 4.

Figure 3:
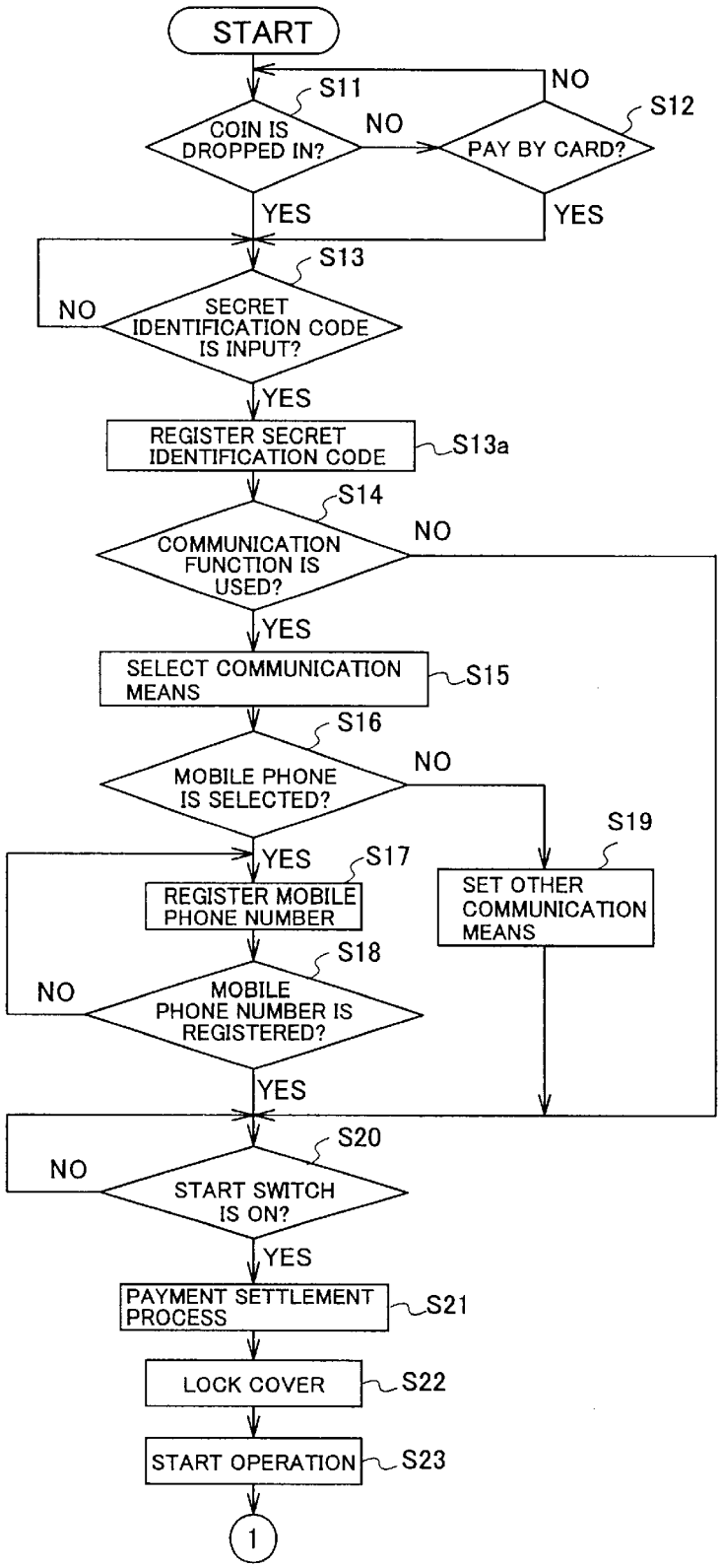
FIGS. 3 and 4 show parts of a flow chart for explaining a monitoring process performed by a control circuit in the embodiment.
Figure 4:
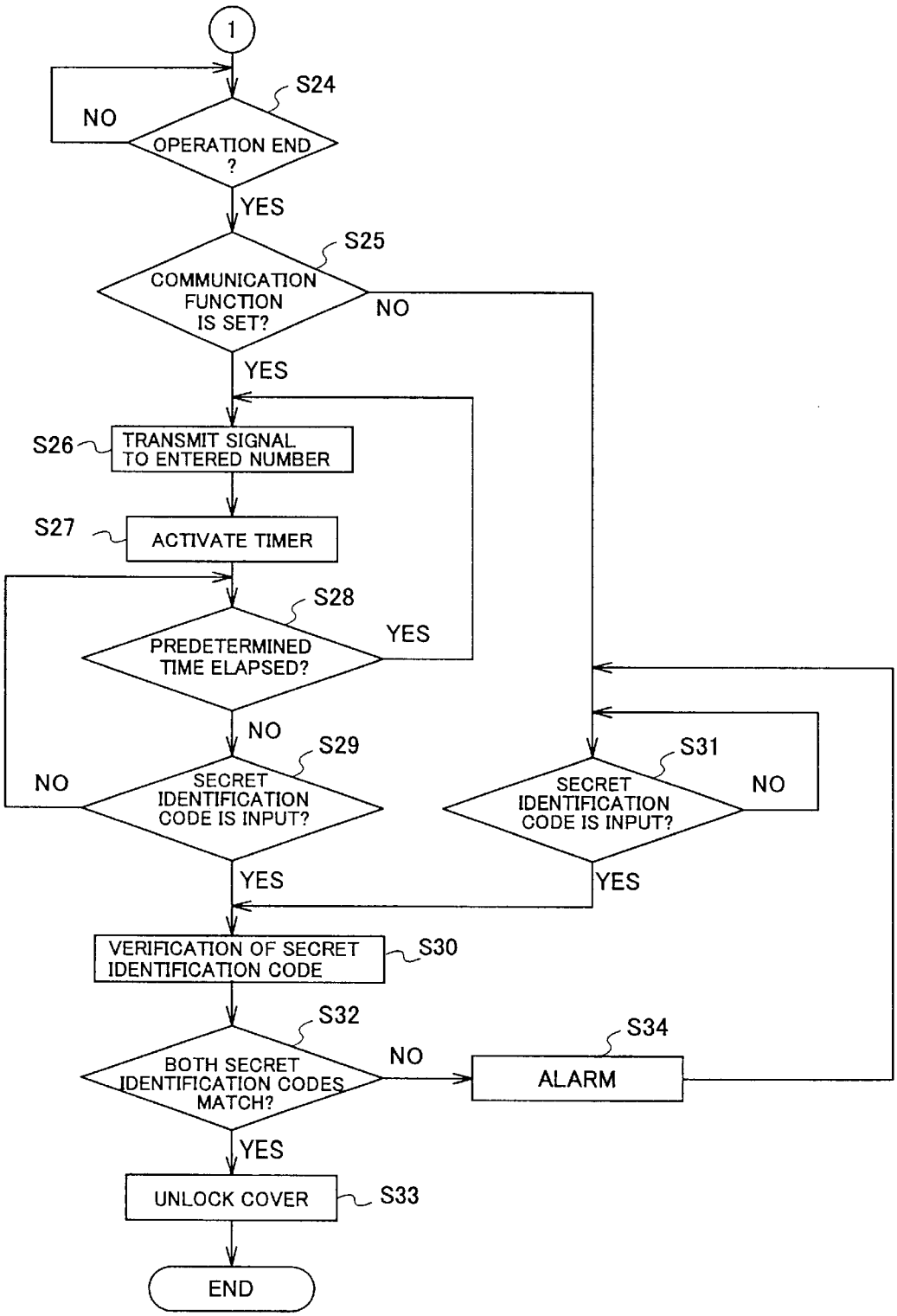

As shown in FIG. 3, in step S11, the control circuits 34 or 40 determines whether or not coins are dropped in. If coins are not dropped in (NO in step S11), the process proceeds to step S12. In step S12, it is determined whether or not a payment is made with a credit card. When the payment is not made with a credit card (NO in step S12), the process returns to step S11.

If coins are dropped in (YES in step S11), or if the payment is made with the credit card (YES in step S12), it is determined whether or not a secret identification code (for example, a combination of four numbers) of the electromagnetic type cover lock mechanism 30 or 38 is input in step S13. If the secret identification code is input (YES in step S13), the input secret identification code is registered in memory in step S13*a*. If the secret identification code is not input (NO in step S13), step S13 is repeated until it is determined that the secret identification code is input.

In step S14, whether or not the communication function is used is determined. If it is determined that the communication function is not used (NO in step S14), the process proceeds to step S20. When the user directs the use of the communication function by using the operation unit 28 (YES in step S14), the process proceeds to step S15. In step S15, a communication means (for example, a mobile phone, a telephone, a facsimile machine, a personal computer, and the like) is selected. Then, the type of the communication means selected by the user using the operation unit 28 is registered in memory.

In step S16, whether or not the user selected the mobile phone 22 is determined. If it is determined that the mobile phone 22 is selected (YES in step S16), the process proceeds to step S17. In step S17, a mobile phone number input by the user is registered in the memory. In step S18, whether or not the mobile phone number is registered is determined. If it is determined that the mobile phone number is not registered (NO in step S18), the process returns to step S17. If it is determined that the mobile phone number is registered (YES in step S18), the process proceeds to step S20.

Additionally, in step S16, if it is determined that the user does not select the mobile phone 22 (NO in step S16), the process proceeds to step S19. In step S19, a setting process (entry of a telephone number, a fax number, an e-mail address and the like) of other communication means (for example, a telephone, a facsimile machine, a personal computer and the like) is performed. Thereafter, the process proceeds to step S20.

In step S20, whether or not a start switch is turned ON is determined. If it is determined that the start switch is turned ON (YES in step S20), a payment settlement process is performed in step S21. If it is determined that the start switch is not turned ON (NO in step S20), step S20 is repeated until it is determined that the start switch is turned ON. Then, in step S22, the electromagnetic type cover lock mechanism 30 or 38 of the washing machine 14 or the drying machine 16, respectively, is caused to perform a lock operation. Thereafter, in step S23, the washing machine 14 or the drying machine 16 starts a washing operation or a drying operation, respectively.

The following steps are explained with reference to FIG. 4. In step S24 shown in FIG. 4, it is determined whether or not the washing operation or the drying operation is finished. If the decision result in step S24 is NO, step S24 is repeated until the decision result is YES. If the decision result in step S24 is YES, whether or not the communication function is set is determined in step S25. If the decision result in step S25 is YES, the process proceeds to step S26. In step S26, an operation end signal is transmitted to the registered mobile phone number or the registered number of other communication means.

The operation end signal is transmitted to the monitoring apparatus 18. Thereafter, the operation end signal is transmitted to the mobile phone 22 or other communication means (for example, a telephone, a facsimile machine, a personal computer and the like) via the communication apparatus 20. Additionally, the mobile phone 22 receiving the operation end signal reports information, that is, the end of the washing operation or the drying operation by voice or by displaying a message on a display part. Further, similarly, the other communication means (for example, a telephone, a facsimile apparatus, a personal computer and the like) also reports the received information indicating the end of the operation by voice, by displaying a message on a display part, or by outputting a facsimile on paper, for example.

In step S27, a timer is put into operation. In step S28, whether or not count time of the timer reaches a predetermined time is determined. If the predetermined time has elapsed (YES in step S28), the process returns to step S26. Steps S26 through S28 are repeated until the decision result in step S28 becomes NO. Thus, the operation end signal is transmitted with a predetermined time interval.

If the predetermined time has not elapsed (NO in step S28), the process proceeds to step S29. In step S29, it is determined whether or not the secret identification code for unlocking is input. If the decision result in step S29 is NO, the process returns to step S28. When the user returns to the laundromat 12 and inputs the secret identification code from the operation unit 28 (YES in step S29), the process proceeds to step S30. In step S30, the input secret identification code is compared with the secret identification code registered in memory.

On the other hand, in step S25, if it is determined that the communication function is not set (NO in step S25), the process proceeds to step S31. In step S31, it is determined whether or not the secret identification code for unlocking is input. If the decision result in step S31 is NO, step S31 is repeated until the decision result in step S31 is YES. If the decision result in step S31 is YES, the process proceeds to step S30.

In step S32, it is determined whether or not both secret identification codes match. If both identification codes match (YES in step S32), the process proceeds to step S33. In step S33, the lock of the electromagnetic type cover lock mechanism 30 or 38 of the washing machine or the drying machine, respectively, is unlocked so that the laundry can be taken out.

However, when both secret identification codes do not match (NO in step S32), the process proceeds to step S34. In step S34, an alarm sounds and unauthorized unlocking is prevented. Thereafter, the process returns to step S31. When the secret identification code is input again (YES in step S31), the process proceeds again to step S30.

Hence, when the user has the mobile phone 22, an operation end signal of the washing machine 14 or the drying machine 16 is transmitted to the mobile phone 22. Therefore, even when the user is distant from the laundromat 12, the user can return to the laundromat 12 with the right timing immediately after the end of the operation.

Additionally, the cover of the washing machine 14 or the drying machine 16 is not unlocked until the secret identification code is input. Accordingly, others can not take out the laundry arbitrarily. Thus, theft can be positively prevented.

Further, in this embodiment, the secret identification code is input in step S13, and the verification of the secret identification code is performed in steps S29 through S32 so as to unlock the cover. However, the cover may be unlocked by using a sender notification function of the mobile phone 22. That is, the cover is unlocked when the telephone number registered in step S17 and sender information transmitted from the mobile phone 22 match. In this case, the telephone number itself serves as the secret identification code. Thus, it is possible to prevent the user from forgetting the secret identification code that the user input, and being unable to unlock the cover. Additionally, since the cover cannot be unlocked without the mobile phone 22, the theft can be more positively prevented.

Of course, an unlocking method of the cover may be selected from the verification of secret identification code and the verification of sender information.

Next, a description will be given of a variation of the above-mentioned embodiment.

Figure 5:
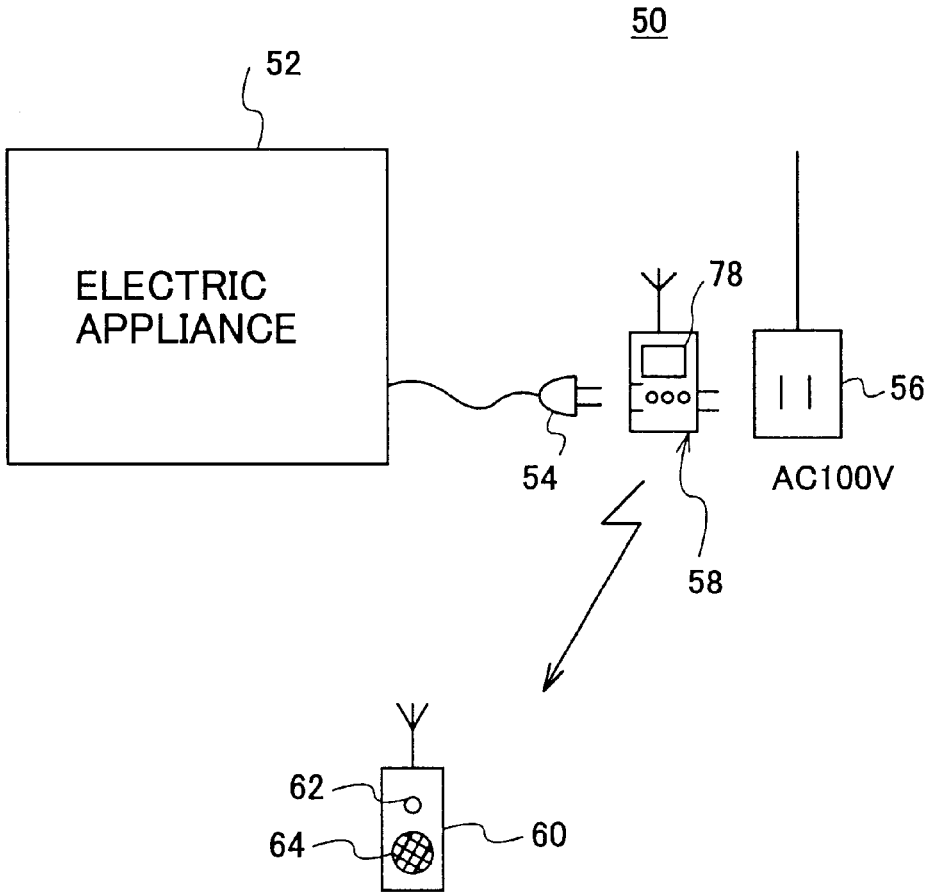
FIG. 5 is a schematic diagram showing the general structure of an electric appliance monitoring system according to a variation of the embodiment of the present invention.
Figure 6:
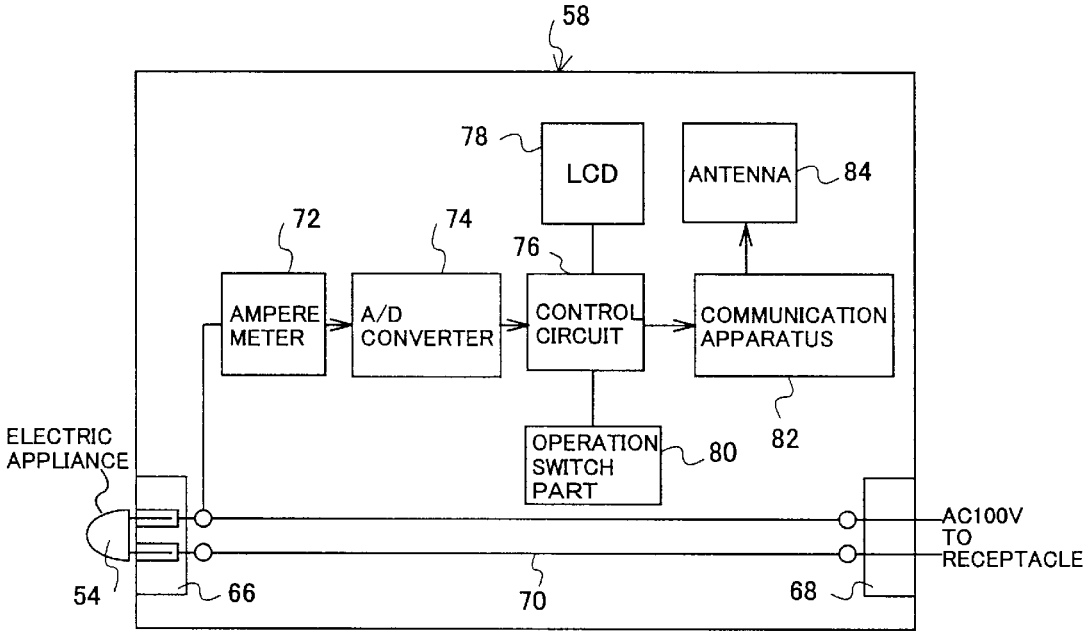
FIG. 6 is a block diagram showing internal components of a monitoring apparatus of the variation.

FIG. 5 is a schematic diagram showing the general structure of an electric appliance monitoring system 50 of the variation. FIG. 6 is a block diagram showing internal components of a monitoring apparatus 58. In FIG. 6, those parts that are the same as those corresponding parts in FIG. 5 are designated by the same reference numerals.

As shown in FIG. 5, the electric appliance monitoring system 50 according to the variant monitors variation of a value of current provided to an electric appliance 52 such as a washing machine or a drying machine by setting the monitoring apparatus 58 between a power plug 54 of the electric appliance 52 and a receptacle 56 of an electric power supply (AC 100 V, for example).

The monitoring apparatus 58 transmits an operation end signal by radio wave when the value of current provided to the electric appliance 52 becomes less or equal to a predetermined value. Then, the transmitted signal is received by a receiver 60 that is installed in a place (another room in a house, for example) distant from the electric appliance 52. The receiver 60 reports the end of the operation of the electric appliance 52 by lighting a light-emitting diode (LED) 62 or sounding an alarm from a speaker 64.

Accordingly, by setting the receiver 60 on a television stand in a living room or in a kitchen, it is possible to easily be informed of the end of the operation of a washing machine or a drying machine while doing another errand. Thus, it is possible to avoid the laundry being taken out late due to not being aware of the end of the operation.

As shown in FIG. 6, the monitoring apparatus 58 includes a receptacle 66, a power plug 68, and a cable 70. The power plug 54 of the electric appliance 52 is plugged into the receptacle 66. The power plug 68 is plugged into the receptacle 56 of the electric power supply (AC 100 V, for example). The cable 70 connects the receptacle 66 and the power plug 68.

Further, the monitoring apparatus 58 includes an ampere meter 72, an A/D converter 74, a control circuit 76, a display part (LCD) 78, an operation switch part 80, a communication apparatus 82 and an antenna 84. The ampere meter 72 measures the value of current flowing through the cable 70. The A/D converter 74 converts the measured value output from the ampere meter 72 to a digital signal. The control circuit 76 determines an operational state by comparing the measured value with a predetermined value. The display part 78 displays the operational state. The operation switch part 80 is for inputting a predetermined value. The communication apparatus 82 transmits an operation end signal. The antenna 84 transmits the operation end signal as a radio wave.

Figure 7:
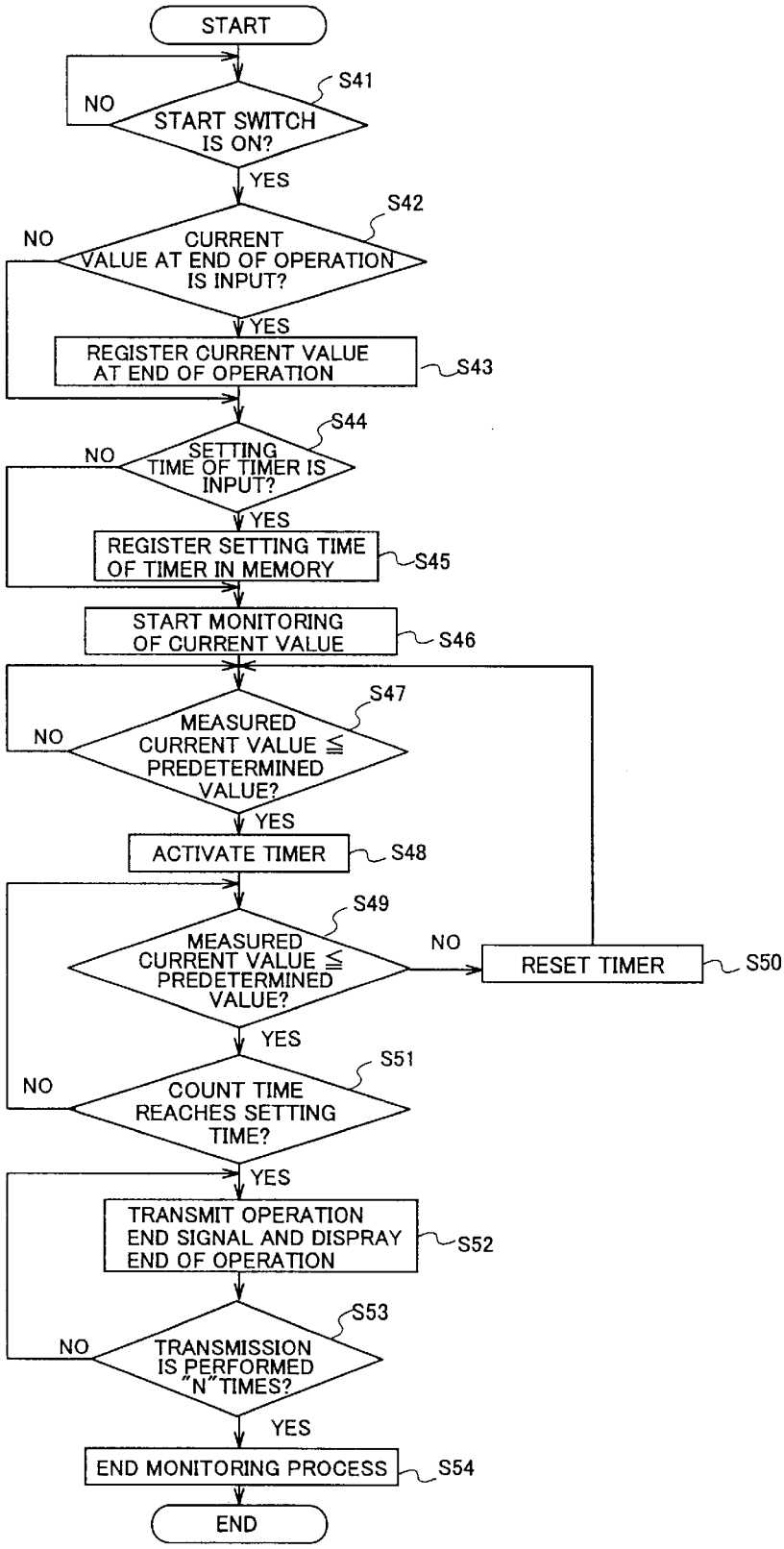
FIG. 7 is a flow chart for explaining a monitoring process performed by a control circuit according to the variation of the embodiment of the present invention.

Next, a description will be given of a control process performed by the control circuit 76 of the monitoring apparatus 58 configured as mentioned above, with reference to a flow chart shown in FIG. 7.

In step S41, it is determined whether or not a start switch of the operation switch part 80 is turned ON. If the decision result in step S41 is NO, step S41 is repeated until the decision result in step S41 is YES. If it is determined that the start switch is turned ON (YES in step S41), the process proceeds to step S42. In step S42, it is determined whether or not a value of current at the end of the operation is input. If the decision result in step S42 is NO, the process proceeds to step S44. If the value of current at the end of the operation is input from the operation switch part 80 in step S42 (YES in step S42), the value of current thereof is registered in memory in step S43. It should be noted that when the value of current at the end of the operation is already input in step S42, it is not necessary to input the value of current each time. Thus, the process in step S43 is skipped without inputting the value of current at the end of the operation.

In step S44, whether or not setting time of a timer is input is determined. When the setting time of the timer is input from the operation switch part 80 in step S44 (YES in step S44), the setting time is registered in the memory in step S45. It should be noted that when the setting time is already input in step S44, it is not necessary to input the setting time each time. Thus, the process in step S45 is skipped without inputting the setting time of the timer. On the other hand, when the setting time of the timer is not input in step S44 (NO in step S44), the process proceeds to step S46.

In step S46, monitoring of a value of current used by the electric appliance 52 is started. Thereafter, in step S47, it is determined whether or not the value of current measured by the ampere meter 72 is equal to or less than the predetermined value that is previously entered. If the measured value of current is equal to or less than the predetermined value in step S47 (YES in step S47), the process proceeds to step S48, and the timer is started. Step S47 is repeated until the decision result in step S47 is YES.

In step S49, it is determined again whether or not the value of current measured by the ampere meter 72 is equal to or less than a predetermined value that is previously registered. If the measured value of current is more than the predetermined value (NO in step S49), the process proceeds to step S50. In step S50, the timer is reset, and the process returns to step S47.

On the other hand, if the measured value of current is equal to or less than the predetermined value (YES in step S49), the process proceeds to step S51. In step S51, it is determined whether clocking time of the timer reaches the setting time. If the clocking time does not reach the setting time (NO in step S51), the process returns to step S49.

Additionally, in step S51, when the clocking time reaches the setting time (YES in step S51), the process proceeds to step S52. In step S52, an operation end signal of the electric appliance 52 is transmitted. The operation end signal is transmitted from the communication apparatus 82 to the receiver 60 at a distant place via the antenna 84. When the receiver 60 receives the operation end signal, the receiver 60 notifies the user of the end of the operation of the electric appliance 52 by lighting the light-emitting diode (LED) 62, or by sounding the alarm from the speaker 64. In addition, the monitoring apparatus 58 displays information indicating the end of the operation of the electric appliance 52 on the display part 78 so as to notify the user near to the monitoring apparatus 58.

In step S53, it is determined whether or not transmission is performed "n" times (where "n" is a predetermined number). If the decision result in step S53 is NO, the process returns to step S52. The transmission process in step S52 is repeated until the decision result in step S53 is YES. When the transmission is performed "n" times (YES in step S53), the process proceeds to step S54. In step S54, the monitoring process this time is ended.

As described above, the monitoring apparatus 58 can simply transmit the operation end signal to the receiver 60 located in a place distant from the electric appliance 52 so as to notify the user of the operational state of the electric appliance 52, by being provided between the power plug 54 of the electric appliance 52 and the outlet 56 of the electric power supply (AC 100 V, for example).

Additionally, the monitoring apparatus 58 is compact and light weight. Furthermore, the monitoring apparatus 58 determines the operational state of the electric appliance 52 from the variation of the value of current provided to the power plug 54. Thus, it is possible for anyone to easily attach the monitoring apparatus 58. Specifically, it is possible to easily attach the monitoring apparatus 58 to an electric appliance that is already installed in home at a relatively low cost. Accordingly, the monitoring apparatus 58 can monitor an operational state of any type of an electric appliance.

The present invention is not limited to the specifically disclosed embodiments, and variations and modifications may be made without departing from the scope of the present invention.

The present application is based on Japanese priority application No. 2001-296942 filed on Sep. 27, 2001, the entire contents of which are hereby incorporated by reference.

What is claimed is:

1. An electric appliance monitoring system, comprising:

a storing part that stores an input secret identification code;

a locking part that locks a predetermined operational state of the electric appliance:

a charge settlement part linked to said locking part;

a monitoring part that monitors an operational state of an electric appliance and outputs a detection signal;

a transmission part that transmits a signal corresponding to said detection signal output from said monitoring part;

a reporting part that reports the operational state of the electric appliance based on a monitoring result corresponding to the signal transmitted from said transmission part; and an unlocking part that determines whether a secret identification code input after said locking part locks the predetermined operational state matches the secret identification code stored in said storing part, and unlocks the predetermined operational state when the secret identification code input after said locking part locks the predetermined operational state matches the secret identification code stored in said storing part.

2. The electric appliance monitoring system as claimed in claim 1, wherein the transmission part becomes communicative when a mobile phone number is input.

3. The electric appliance monitoring system as claimed in claim 1, wherein the reporting part reports the operational state of the electric appliance to a user of a mobile phone by using at least one of a speaker and a display screen of said mobile phone.

4. The electric appliance monitoring system as claimed in claim 1, wherein the monitoring part is provided between a power plug of the electric appliance and a receptacle, the monitoring part monitoring changes in an electric current at said power plug.

5. The electric appliance monitoring system as claimed in claim 1, wherein the secret identification code stored in the storing part is a telephone number of a mobile phone that receives the signal output from the transmission part, and the unlocking part determines whether the telephone number stored in the storing part matches a telephone number included in sender information output by said mobile phone.

6. The electric appliance monitoring system as claimed in claim 1, wherein the reporting part is a facsimile apparatus.

7. The electric appliance monitoring system as claimed in claim 1, wherein the reporting part is a personal computer, and the personal computer reports the operational state of the electric appliance based on a monitoring result corresponding to the signal transmitted from the transmission part via the Internet.

8. The electric appliance monitoring system as claimed in claim 1, wherein the charge settlement part allows payment in cash.

9. The electric appliance monitoring system as claimed in claim 1, wherein the charge settlement part allows payment with a credit card.

10. An electric appliance monitoring system, comprising:

a storing part that stores input identification information of a mobile phone;

a monitoring part that monitors an operational state of an electric appliance and outputs a detection signal;

a transmission part that transmits to the mobile phone a signal corresponding to said detection signal output from said monitoring part;

a reporting part that reports via the mobile phone the operational state of the electric appliance based on the signal transmitted from said transmission part; and a locking part that locks a predetermined operational state of the electric appliance, determines whether the identification information stored in said storing part matches identification information of the mobile phone input after the predetermined operational state of the electric appliance is locked, and unlocks the predetermined operational state when the identification information stored in said storing part matches the identification information of the mobile phone.

11. The electric appliance monitoring system as claimed in claim 10, further comprising:

a charge settlement part linked to the locking part.

12. The electric appliance monitoring system as claimed in claim 11, wherein the charge settlement part allows payment in cash.

13. The electric appliance monitoring system as claimed in claim 11, wherein the charge settlement part allows payment with a credit card.

* * * * *